US011866278B2

(12) United States Patent
Baldaccini

(10) Patent No.: US 11,866,278 B2
(45) Date of Patent: Jan. 9, 2024

(54) PAPER MILL REWINDER WITH CONTINUOUS REEL CHANGE DEVICE

(71) Applicant: TECNO PAPER SRL, Capannori (IT)

(72) Inventor: Paolo Baldaccini, Capannori (IT)

(73) Assignee: TECNO PAPER SRL, Capannori (IT)

( * ) Notice: Subject to any disclaimer, the term of this patent is extended or adjusted under 35 U.S.C. 154(b) by 348 days.

(21) Appl. No.: 17/282,670

(22) PCT Filed: Oct. 2, 2019

(86) PCT No.: PCT/IT2019/050216
§ 371 (c)(1),
(2) Date: Apr. 2, 2021

(87) PCT Pub. No.: WO2020/070765
PCT Pub. Date: Apr. 9, 2020

(65) Prior Publication Data

US 2021/0339974 A1 Nov. 4, 2021

(30) Foreign Application Priority Data

Oct. 5, 2018 (IT) ..... 102018000009199

(51) Int. Cl.
*B65H 19/30* (2006.01)
*B65H 19/22* (2006.01)

(52) U.S. Cl.
CPC ..... *B65H 19/223* (2013.01); *B65H 19/2246* (2013.01); *B65H 19/2253* (2013.01);
(Continued)

(58) Field of Classification Search
CPC ..... B65H 19/22; B65H 19/30; B65H 19/223; B65H 19/2253; B65H 19/2269;
(Continued)

(56) References Cited

U.S. PATENT DOCUMENTS 4,905,925 A * 3/1990 Kremar ..... B65H 19/30
242/542.3
5,063,970 A * 11/1991 Tanaka ..... B65H 19/22
242/533.3

(Continued)

FOREIGN PATENT DOCUMENTS

DE 10 2008 018 890 10/2009
EP 0 860 391 8/1998

(Continued)

OTHER PUBLICATIONS

International Search Report for PCT/IT2019/050216 dated Jan. 17, 2020, 4 pages.
Written Opinion of the ISA for PCT/IT2019/050216 dated Jan. 17, 2020, 6 pages.

*Primary Examiner* — Sang K Kim
(74) *Attorney, Agent, or Firm* — NIXON & VANDERHYE

(57) ABSTRACT

The invention pertains to the field of industrial machinery for converting paper and/or for processing strip materials, and relates to a paper mill rewinder for forming reels of paper strip material, in particular, but not exclusively, tissue paper, of conventional or structured type, non-woven, TAD (Through Air Drying), or other similar materials characterized by having a very light weight and low density, with continuous, or non-stop, reel change device. Said rewinder (1) comprises: —a supporting frame (3); —feed means (4) for a winding rod (A); —a main forming cradle (C1) for a reel (B) around said winding rod (A), comprising a first (5) and a second (6) winding roller; —means for unloading (7) said reel (B) once formed; —a control unit, —a secondary pre-forming cradle (C2) for said reel (B), comprising a third winder roller (8) and lateral supporting means for said reel (B); —means for transferring said reel (B) from said secondary pre-forming cradle (C2) to said main forming cradle
(Continued)

(C1), where said transfer takes place without interruption to the winding, of the strip (N) onto said rod (A).

9 Claims, 6 Drawing Sheets

(52) U.S. Cl.
CPC ..... *B65H 19/2269* (2013.01); *B65H 19/30* (2013.01); *B65H 2301/41427* (2013.01); *B65H 2408/235* (2013.01); *B65H 2801/84* (2013.01)

(58) Field of Classification Search
CPC .... B65H 2301/41427; B65H 2408/235; B65H 2801/84
See application file for complete search history.

(56) References Cited

U.S. PATENT DOCUMENTS

| | | | | | |
|---|---|---|---|---|---|
| 5,249,758 | A | | 10/1993 | Mueller et al. | |
| 5,544,841 | A | * | 8/1996 | Didier | B65H 18/26 242/542.3 |
| 5,593,106 | A | | 1/1997 | Cavanagh | |
| 5,690,298 | A | * | 11/1997 | Ruck | B65H 19/2261 242/542.3 |

FOREIGN PATENT DOCUMENTS

| | | |
|---|---|---|
| IT | FI2010000041 | 9/2011 |
| WO | 93/06033 | 4/1993 |
| WO | 2011/114361 | 9/2011 |

* cited by examiner

PAPER MILL REWINDER WITH CONTINUOUS REEL CHANGE DEVICE

CROSS-REFERENCE TO RELATED APPLICATIONS

This application is the U.S. national phase of International Application No. PCT/IT2019/050216 filed Oct. 2, 2019 which designated the U.S. and claims priority to IT 102018000009199 filed Oct. 5, 2018, the entire contents of each of which are hereby incorporated by reference.

TECHNICAL FIELD

The invention pertains to the field of industrial machinery for converting paper and/or for processing strip materials.

More in detail, the invention relates to a paper mill rewinder for forming reels of paper strip material, in particular, but not exclusively, tissue paper, of conventional or structured type, nonwoven, TAD (Through Air Drying), or other similar materials characterized by having a very light weight and low density, with continuous, or non-stop, reel change device.

STATE OF THE ART

The rewinder is a machine that allows the rewinding of strips previously unwound from reels of large diameter (parent reels) onto reels with small diameters along a converting line.

Conventional paper mill rewinders are of start-stop type in which feed of the strip is interrupted to allow removal of the reel just formed and insertion into the machine a new winding rod, optionally with a core made of cardboard or other suitable material, around which the subsequent reel will be formed.

These rewinders normally have a winding area structured as cradle and defined by two winding rollers; a winding rod around which the reel is formed in inserted into the cradle formed between the two rollers. The reel is formed above the cradle between the two rollers with a gradual increase of diameter. After winding feed is interrupted, the formed reel is unloaded from the winding cradle, ejected toward a tilting unloading surface (or other suitable accessory) that ejects it from the rewinder.

This cycle is interrupted repeatedly until the strip material from the parent reel is exhausted. For each finished reel ejected from the rewinder, the strip material is severed with the machine stopped to form a new tail to start winding around a subsequent rod.

These rewinders have important disadvantages due to the non-continuous nature of the process: the stop and start cycles of the rewinders lead to production losses and also stresses in the production line and high power consumption due to a cyclic and constant start-stop of the machine, caused by the power required to overcome, during the acceleration and deceleration ramps, all the inertias both due to the reels of strip materials (parent reel and smaller reel) in movement and due to the mechanical members of the machine.

To attempt to overcome this problem, rewinders have been designed that do not stop during the reel changed, hence defined non-stop.

The industrial invention patent application No. FI2010A000041 discloses a rewinder for winding reels of strip material of non-stop type.

This rewinder comprises a forming cradle for a reel comprising a first and a second winding roller, and a winding rod inserter to insert a winding rod into said cradle.

Said inserter is placed to insert a new rod against the first winding roller, while the second winding roller is formed and placed to allow unloading of the previously formed reel from said cradle.

During reel change the following steps take place:

- the winding speed of the strip is slowed down;
- the arrangement of the second winding roller changes from a winding position toward an unwinding position moving the first reel away from the first winding roller and toward an unloading area;
- a second winding rod is carried into contact with the first winding roller causing rotation of said second rod to start;
- the strip starts to be wound around the second rod to form the second reel;
- the second winding roller is moved toward the winding position again, restoring the structure of the forming cradle.

This solution also has important disadvantages.

Firstly, although being a rewinder of non-stop type and hence without machines stops, the operating speed is nonetheless greatly reduced at each reel change, with inevitable slowdowns of the whole processing line and a lower total productivity.

To ensure a high final quality of the reel, the winding speed and the tension of the strip must be kept substantially constant: continuous changes in the speed of the machine are absolutely unfavorable for the success of reel winding.

Moreover, by using the same forming cradle also for the reel change, the new winding rod can only be positioned in the forming cradle when the previously formed reel has been completely removed from this cradle, and as the reel is of considerable size, the time required for its removal and unloading is not negligible, but affects the whole processing cycle.

Even more disadvantageously, the reels being wound tend to become out of round during the forming phase, due to the weight of the reel left resting on the rollers of the cradle, as no support is provided for the winding rod.

Moreover, also in the unloading and removal phase of the formed reel, the latter is abandoned and not guided in its movement, with inevitable problems of damage to the paper due to pressures and frictions in combination with the delicate nature of the material wound on the reel.

Presentation of the Invention

It is therefore an object of the present invention to overcome the aforementioned negative points, providing a paper mill rewinder for forming reels of paper strip material around a winding rod that is efficient and productive, operates continuously without interruptions and machine stops, protects the reel from any damages and prevents out-of-roundness thereof both during forming and during removal.

The object of the invention is achieved with a paper mill rewinder for forming reels of paper strip material around a winding rod, the ends of which are provided with two spindles, where said rewinder comprises:

- a supporting frame;
- feed means of a winding rod;
- a main forming cradle for a reel around said winding rod, comprising a first and a second winding roller;
- means for unloading said reel once formed;
- a control unit, characterized in that it comprises:

a secondary pre-forming cradle for said reel, comprising a third winder roller and lateral supporting means for said reel;

means for transferring said reel from said secondary pre-forming cradle to said main forming cradle, without interruption to the winding of the strip onto said rod.

According to a first aspect of the invention, said rewinder comprises:

first motor means adapted to cooperate with said spindles and to impart a rotation movement to said winding rod inside said secondary cradle;

gripping means adapted to cooperate idly with said spindles and to support said winding rod above said main cradle.

In a possible variant of embodiment, said transfer means comprise:

a pair of supporting and moving arms for said reel, adapted to provide said lateral support means for said secondary cradle in order to support said reel during the pre-forming phase by keeping it always in contact with said third winding roller and then to transfer said reel into said main cradle, second motor means adapted to impart an oscillating movement to said pair of supporting and moving arms, where said first motor means are associated with said pair of supporting and moving arms.

Moreover, said transfer means comprise a slide placed between said pair of supporting and moving arms and sliding thereupon, adapted to support said reel in the pre-forming phase, and with which said first motor means are in a single piece.

According to a further aspect of the invention, said gripping means comprise a pair of jaws adapted to grip said spindles of said winding rod once said transfer means have moved said reel into said main cradle thereby allowing said first motor means to abandon the spindles.

In particular, said gripping means comprise:

guide means for said jaws;

third motor means of a screw/nut type adapted to impart a vertical translation movement to said jaws, along said guide means.

Even more advantageously, said unloading means of said formed reel comprise:

guide means for said gripping means;

fourth motor means, adapted to impart a horizontal translation movement to said gripping means along said supporting frame by means of said guide means.

In a preferred variant of the invention, said rewinder comprises an index oscillating around an axis, provided at one end with a ply-forming roller adapted to interact with said strip to form a loop and facilitate its winding around said winding rod when placed in said secondary cradle.

Moreover, said rewinder comprises a plurality of nozzles adapted to spray air or water at a determined pressure against said strip to push said loop between said winding rod and said third roller.

According to a further aspect of the invention, said feed means of said winding rod comprise:

a pair of jaws adapted to grip the spindles of said winding rod;

a vertical downward conveyor for said jaws, adapted to cooperate with said transfer means in the proximity of said secondary pre-forming cradle.

The invention has numerous advantages substantially due to the reel change being performed outside the primary forming cradle.

Advantageously, it is possible to pre-form a new reel outside the main cradle, occupying the time lapse required to unload the previously formed reel. In this way the processing times are optimized and machine stops are not necessary. The rewinder according to the invention therefore operates entirely in non-stop mode.

The transfer means of the pre-formed reel from the secondary cradle to the main cradle operate independently relative to the winding rollers: the reel continues to be formed as a result of the rotation operation of the winding rollers, initially due to the third winding roller with which it is always in contact and subsequently due to the first and to the second winding roller between which it is positioned during the actual forming phase, also during its movement from one cradle to the other.

Even more advantageously, according to the invention the winding rod, due to its pair of spindles, is always supported and guided both in the pre-forming phase in the secondary cradle, and in the forming phase in the main cradle.

In the secondary cradle the spindles of the winding rod are engaged by first motor means that rotate the rod promoting winding of the strip around it.

The spindles are not abandoned by the first rotation motor means until the reel is in the main cradle, i.e., until the gripping means of jaw type take over, idly gripping the rod which can continue to rotate as a result of the pull of the strip imparted by the winding rollers below, but remaining suspended, without the full burden of its weight thereon.

The index with ply-forming roller advantageously facilitates the tearing phase of the strip, required to create the tail of the reel already formed and the head of the new reel in the pre-forming phase: the oscillation of the index with ply-forming roller generates a loop above the winding rod, i.e., a slack tail of strip, which is advantageously conveyed between the third winding roller and the rod by the jet of water or compressed air emitted by specific nozzles. Once the loop of the strip is gripped between the rod and the third roller the strip tears separating the formed reel from the reel being pre-formed.

The formed reel is unloaded easily and safely due to the guide means and to the translation motor means, both vertical and horizontal, which support the reel and prevent out-of-roundness from occurring during its movement.

BRIEF DESCRIPTION OF THE DRAWINGS

Further features and advantages of the invention will be more evident from the more detailed description set forth below, with the aid of the drawings, which show a preferred implementation thereof, illustrated by way of non-limiting example, wherein.

DETAILED DESCRIPTION OF A PREFERRED EMBODIMENT OF THE INVENTION

Figure 1:
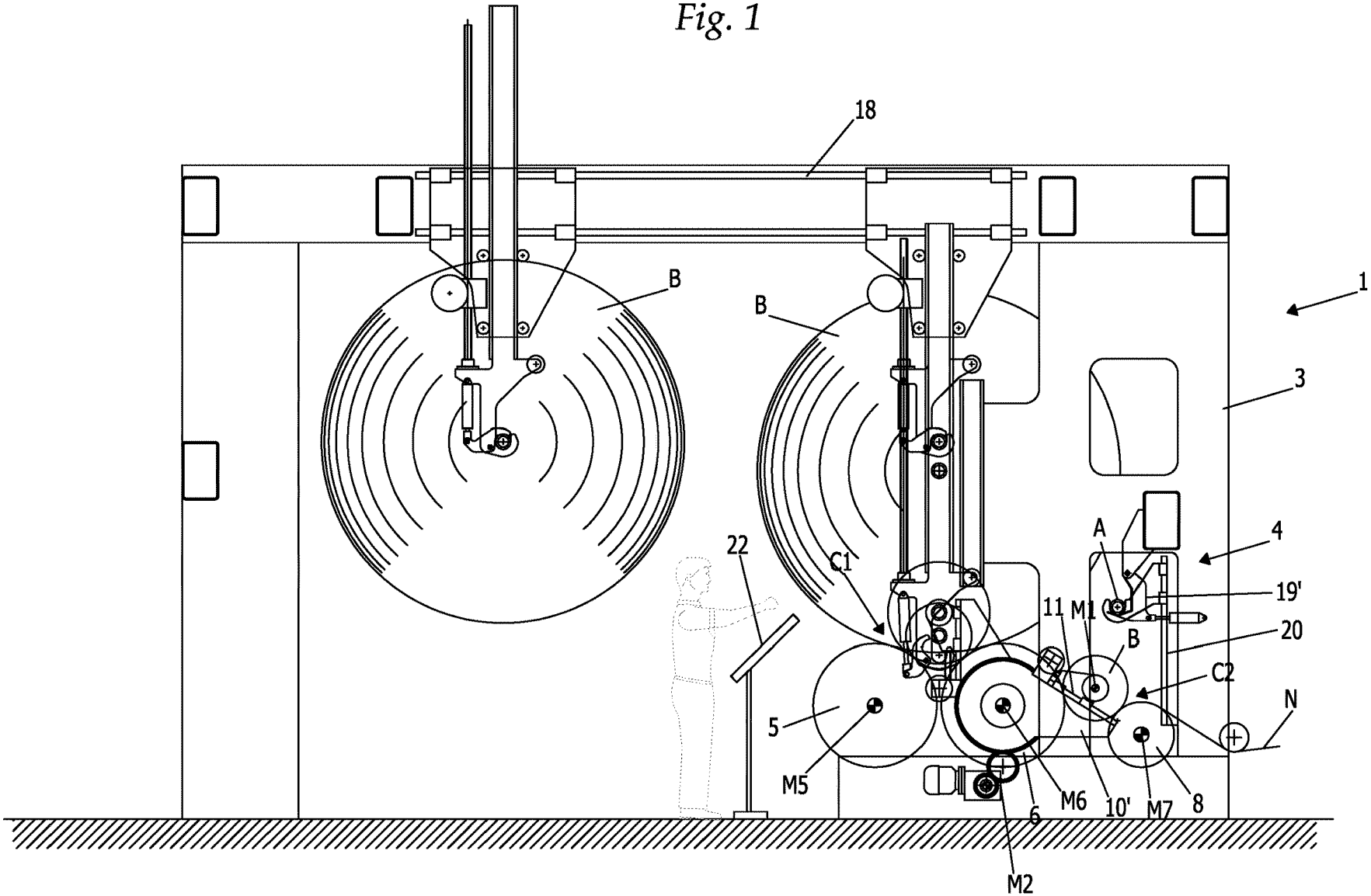
FIG. 1 shows, in a simplified side view represented in transparency for clarity, a paper mill rewinder for forming reels of paper strip material around a winding rod according to the invention.

With reference to the details of the figures, there is illustrated a paper mill rewinder 1 for forming a reel B of paper strip material N around a winding rod A having a longitudinal axis x, the ends of which are provided with spindles 2', 2".

The strip N of material can be wound directly on this rod A, or on a cardboard core placed coaxial to this rod.

Said paper strip material can, by way of non-limiting example, be:

- conventional tissue paper, normally used to manufacture toilet paper or napkins;
- structured tissue paper, i.e., very thick single ply paper with structured and soft texture (very sensitive to problems of flattening and elongation and hence particularly suitable to be handled by unwinders according to the invention);
- nonwoven or TAD (through air drying) paper.

Said rewinder 1 essentially comprises:

- a supporting frame 3;
- feed means 4 for a winding rod A;
- a main forming cradle C1 for a reel B around said winding rod A, comprising a first 5 and a second 6 winding roller;
- a secondary pre-forming cradle C2 for said reel B around said rod A, comprising a third winder roller 8 and lateral supporting means for said reel B;
- means for transferring said reel B from said secondary pre-forming cradle C2 to said main forming cradle C1 without interruption to the winding of the strip N onto said rod,
- means for unloading 7 said reel B once formed;
- motor means for all the kinematic mechanisms of said rewinder 1;
- a control unit.

Said first 5 and said second 6 winding roller that form said main forming cradle C1 are preferably coated with tungsten carbide to provide the strip N with a good grip during winding and hence always maintain a control on the tension of this strip.

Both said winding rollers 5, 6 are motorized and rotate in the same direction to determine winding of the strip N on the rod.

Said third winding roller 8 is also preferable coated with tungsten carbide and in turn rotates in the same direction as said winding rollers 5 and 6.

Said transfer means comprise a pair of supporting and moving arms 10', 10" of said reel B and a slide 11 placed between said pair of arms 10', 10" parallel to the main axis x of said winding rod A, and hence of said reel B, sliding upon said arms.

Said slide 11 is slidable along an inclined plane formed by said arms 10', 10" to keep the contact between said reel B in the pre-forming phase and said third winding roller 8.

In particular, said transfer means are adapted to:

- receive a winding rod A from said feed means 4;
- provide the lateral support for said secondary cradle C2 in order to support said reel B during the pre-forming phase by keeping it always in contact with said third winding roller 8;
- support, through said slide 11, said reel B in the pre-forming phase, allowing it to slide as its diameter increases;
- subsequently transfer said pre-formed reel B into said main cradle C1.

Specifically, said rewinder 1 comprises:

- first motor means M1 stably associated with said slide 11, adapted to cooperate with said spindles 2', 2" and to impart a rotation movement to said winding rod A inside said secondary cradle C2;
- second motor means M2 adapted to impart an oscillating movement to said pair of supporting and moving arms 10', 10", to transfer the pre-formed reel B from said secondary cradle C2 to said main cradle C1.

Said first motor means M1 comprise a pair of motorized conical punches 21', 21".

Said first motor means M1 are associated with said slide 11, so as to be able to move linearly therewith along said inclined plane, in order to always be in contact on the spindles 2', 2" at the ends of said winding rod A while the diameter of the reel B being pre-formed increases.

Said rewinder 1 also comprises gripping means adapted to cooperate idly with said spindles 2', 2" and to support said rod A above said main cradle C1.

Said gripping means comprise a pair of jaws 9', 9" adapted to grip said spindles 2', 2" of said winding rod A once said transfer means have moved said reel B into said main cradle C1 thereby allowing said first motor means M1 to abandon the spindles.

Said jaw gripping means 9', 9" have the function of supporting the reel B being formed to prevent out-of-roundness thereof, above all for very soft low density papers, but also the function of accompanying and unloading the formed reel B.

Said gripping means comprise:

- guide means for said jaws 9', 9";
- third motor means M3 of linear type adapted to impart a vertical translation movement to said jaws 9', 9", to lift said reel B along said guide means and then move it away from said main cradle C1.

Said guide and vertical translation means comprise a linear guide 15, sliding in which is a wheel 16 with which said jaws 9', 9" are associated.

Said third motor means M3 comprise a linear actuator 17 of a screw/nut type.

Said gripping means also cooperate with said unloading means 7 to allow said reel B formed by said main cradle C1 to be moved away.

In fact, said unloading means 7 of said formed reel comprise:

- guide means of the track type 18, provided along said supporting frame 3, along which said gripping means 9', 9" slide;
- fourth motor means (not illustrated) adapted to impart a horizontal translation movement to said gripping means.

Said feed means 4 of new winding rods A also comprise a pair of jaws 19', 19" adapted to grip the spindles 2', 2" of each new winding rod A to take it, with a vertical downward conveyor 20 of known type and cooperating with said transfer means, in the proximity of said secondary pre-forming cradle C2.

Said rewinder 1 comprises a motorized index 12 oscillating around an axis, adapted to interact with said strip N to form a loop and facilitate its winding around said winding rod A when placed in said secondary cradle C2.

In particular, said index 12 is provided at its free end with a ply-forming roller 13 adapted to cause a slack in the strip N around said winding rod A.

Advantageously, in the proximity of said third winding roller 8, there is provided a plurality of nozzles 14 adapted to spray air or water at a determined pressure against said strip N to push said slack of material between said winding rod A and said third roller 8.

In a variant, not illustrated, said nozzles 14 could also spray glue directly onto said winding rod A to promote the adhesion of the strip N and facilitate tearing thereof to separate the reel B already formed with the portion of strip that will subsequently start the new reel.

Said rewinder 1 comprises fifth M5, sixth M6 and seventh M7 motor means adapted to impart a rotation movement respectively to said first 5, second 6 and third winding roller 8.

The operation of the rewinder 1 is described below and with the aid of FIGS. 2-6, both in a side and in a front view.

Figure 2A:
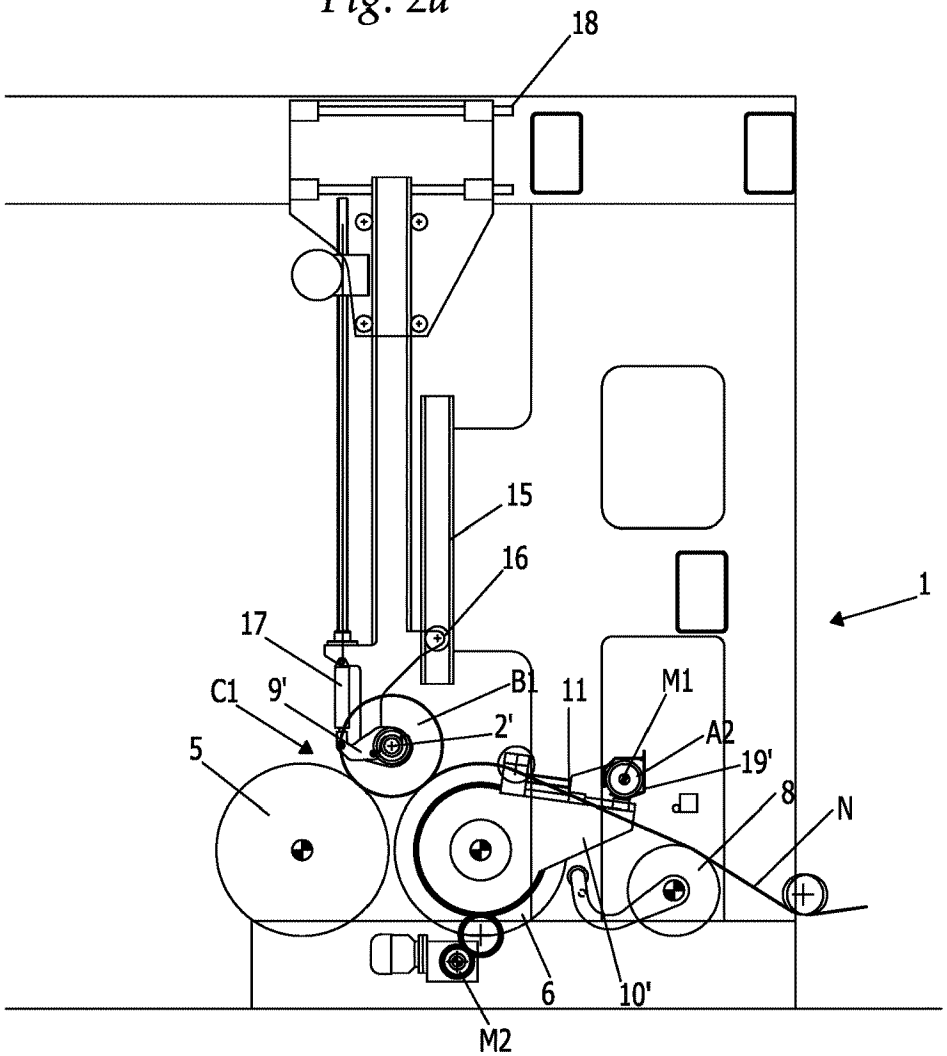
FIGS. 2*a*, 3*a*, 4*a*, 5*a*, 6*a* show, in a simplified side view represented in transparency for clarity, the rewinder of FIG. 1 in five subsequent operating phases.
Figure 2B:
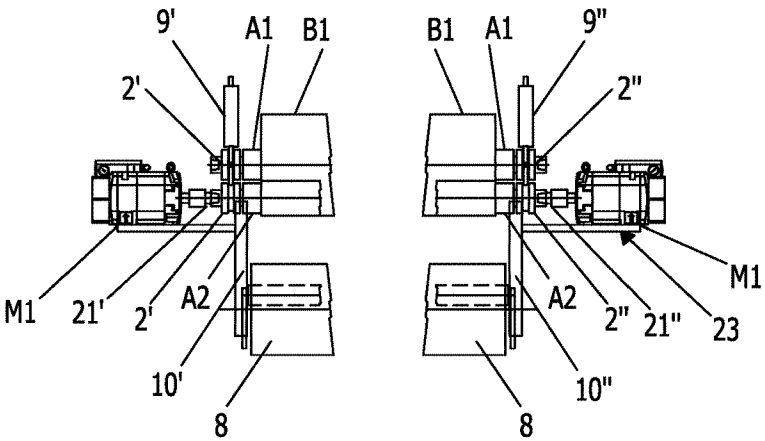
FIGS. 2*b*, 3*b*, 4*b*, 5*b*, 6*b* show, in a partial front view represented in transparency for clarity, a detail of the rewinder according to the invention in the five subsequent operating phases of FIGS. 2*a*, 3*a*, 4*a*, 5*a*, 6*a*, respectively.

FIGS. 2*a* and 2*b* show a phase of winding a first reel B1 around a rod A1 inside said main forming cradle C1 as a result of the rotation of said first 5 and second 6 winding roller. In this phase, the strip N fed is wound around the rod A1 to form a reel B1. The winding rod A1 is supported by the gripping means, i.e., by the jaws 9', 9" that grip the spindles 2', 2" of the rod A1. Simultaneously, said feed means 4 pick up a new winding rod A2 from a magazine to make it available to said pair of supporting and moving arms 10', 10".

Figure 3A:
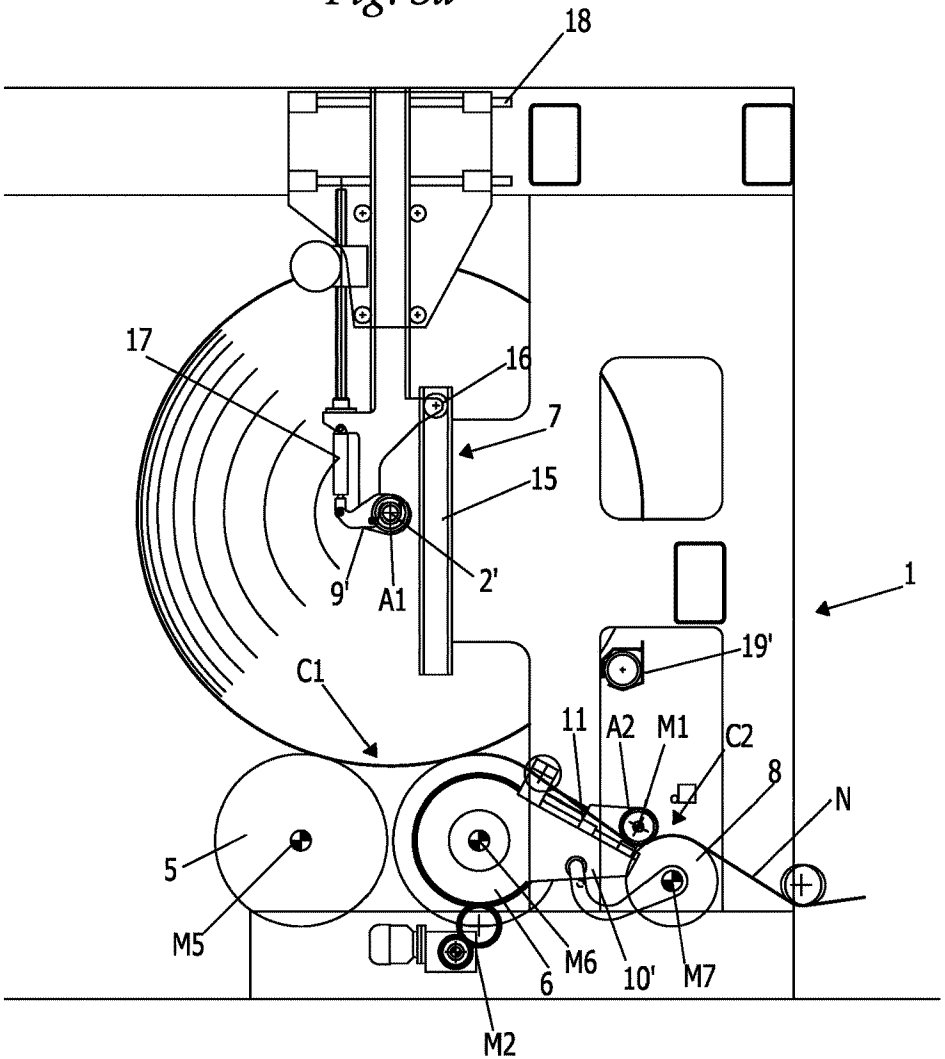
Figure 3B:
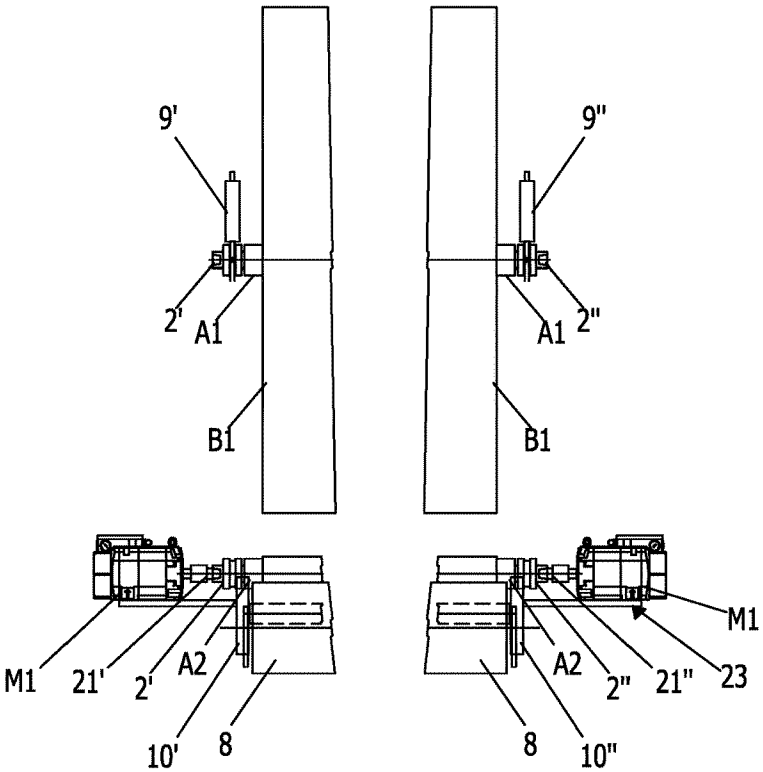

FIGS. 3*a* and 3*b* show the final phase of winding of the reel B1. After reaching the desired diameter, the rewinder 1 starts the reel change cycle: while the reel B1 formed is still in the main forming cradle C1, the pair of supporting and moving arms 10', 10" lower the new winding rod A2 taking it into the secondary pre-forming cradle C2, in contact with said third winding roller 8 and said slide 11. The first motor means M1 in a single piece with the slide 11 engage with the ends of the rod A2.

Figure 4A:
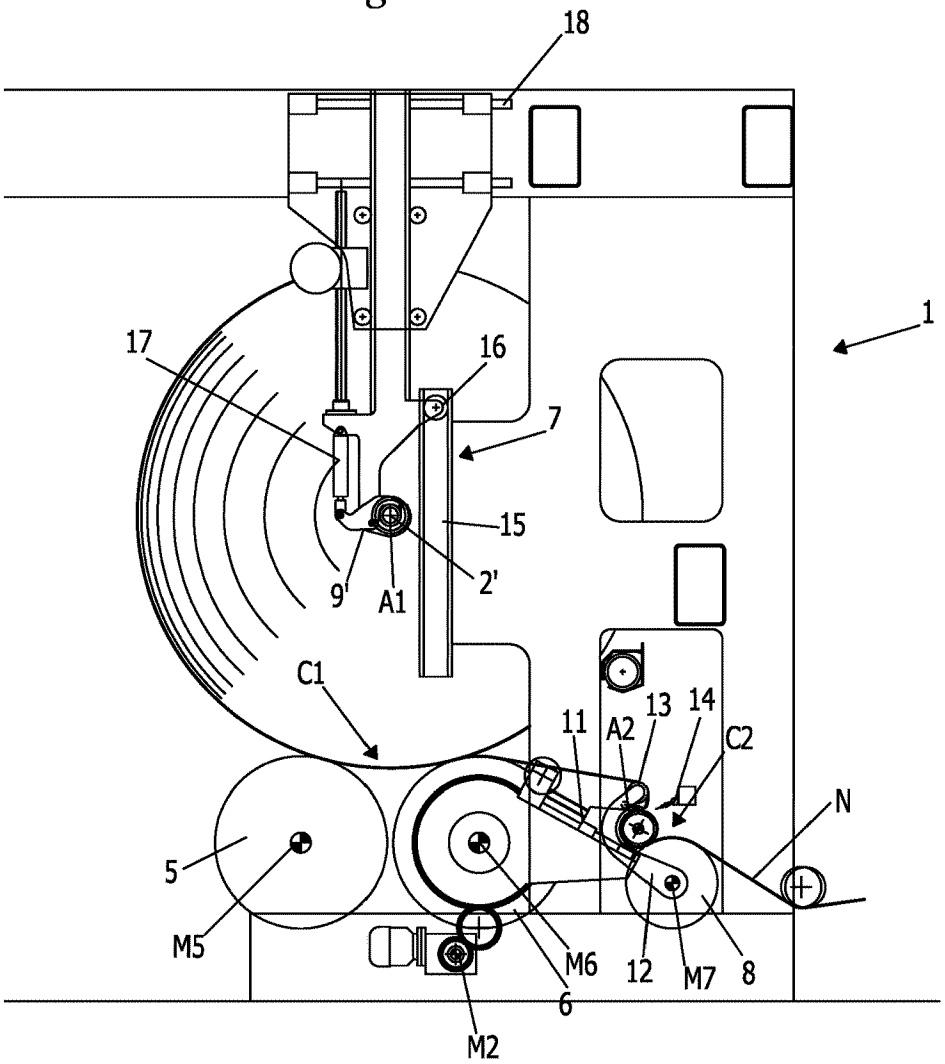
Figure 4B:
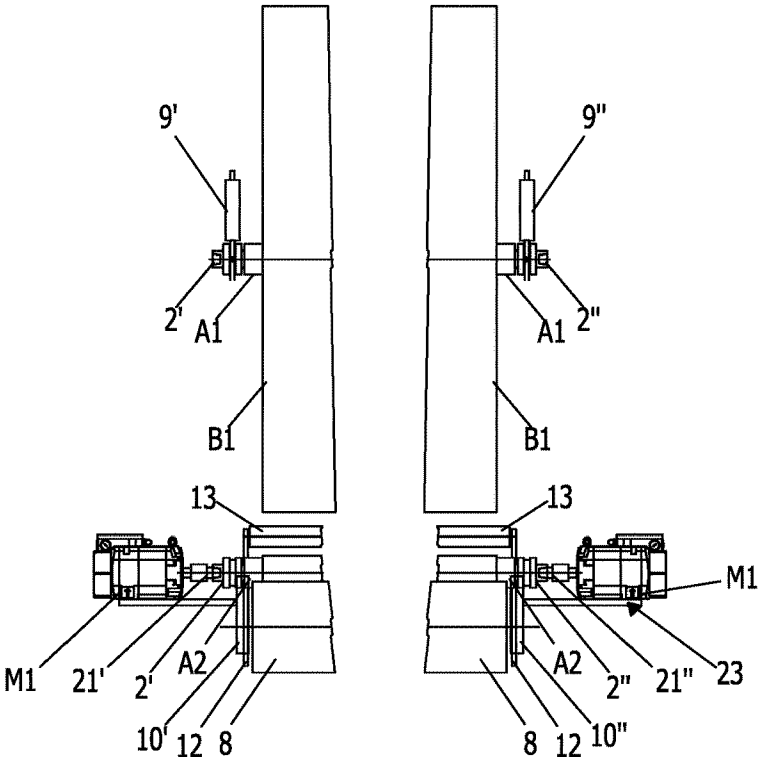

FIGS. 4*a* and 4*b* show the operation of tearing the strip N and of starting winding on the new rod A2: the controller 22 controls the upward oscillation of the index 12 so as to intercept the strip N and surround the rod A2. The nozzles 14 spray pressurized water on the portion of strip N in contact with the ply-forming roller 13 of the index 12, thereby causing the actual tearing of the strip N. The tail N' of the strip completes its winding on the reel B1 already formed, while the head N" of the strip is gripped between the new rod A2 and the third winding roller 8. In a preferred variant, said nozzles 14 could also spray a glue to promote adhesion of the head N" of the strip on the rod A2. The first motor means M1 start to impart a rotation movement to said rod A2: winding of the strip N on said rod A2 and pre-forming of a new reel B2 inside said secondary cradle C2 commence. The formed reel B1, still supported by the gripping means 9', 9", is instead moved away horizontally along the tracks 18 of the supporting frame 3 freeing the main forming cradle C1.

Figure 5A:
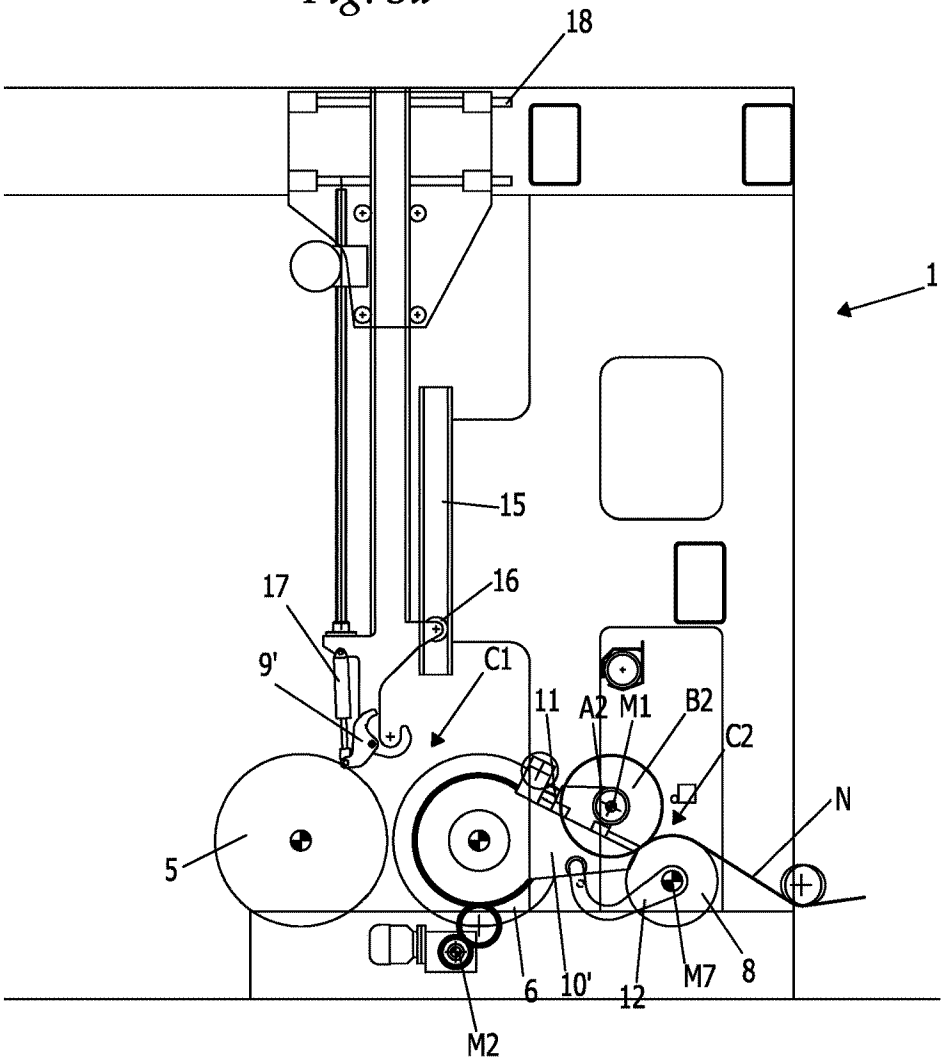
Figure 5B:
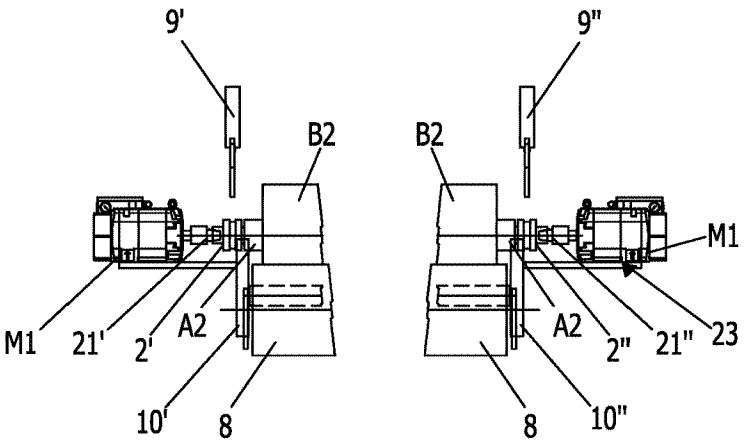

FIGS. 5*a* and 5*b* show the phase of pre-forming the new reel B2 and preparing the main cradle C1, with repositioning of the gripping means 9', 9" above it.

Figure 6A:
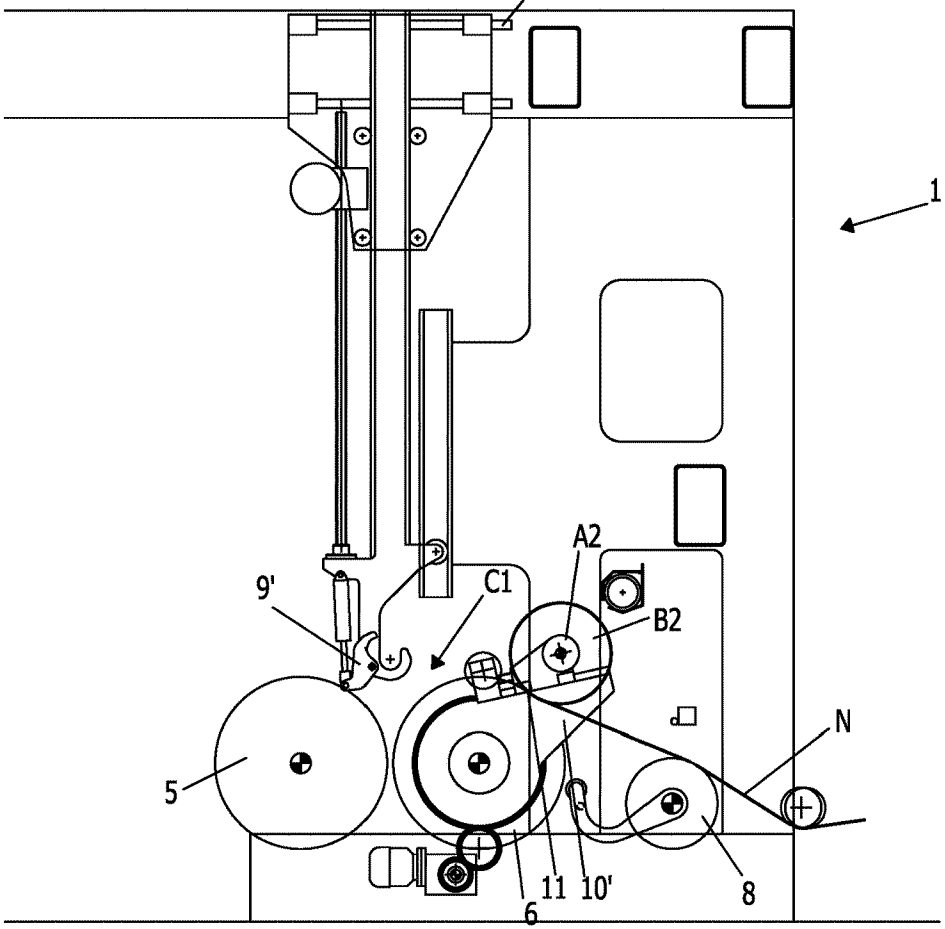
Figure 6B:
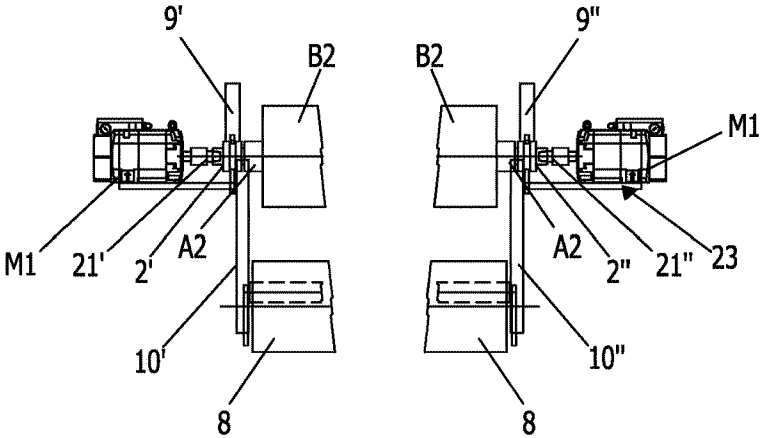

FIGS. 6*a* and 6*b* show the phase of transferring the pre-formed reel B2 from the secondary cradle C2 to the main cradle C1. Said second motor means M2 impart the oscillation of the supporting and moving arms 10', 10" that accompany the rod A2 inside the jaws 9', 9" of the gripping means, which are in the open position above the main cradle C1. Once the rod A2 has been inserted into the jaws 9', 9", the first motor means M1 abandon the spindles 2', 2" of the rod A2 and the pair of arms 10', 10" can return to the initial position to pick up a new rod A3 carried by the feed means 4. The reel B2 instead continues to be formed in the main cradle C1.

The invention claimed is:

1. A paper mill rewinder for forming reels of paper strip material around a winding rod, ends of the winding rod being provided with two spindles, said rewinder comprising:

a supporting frame;

a feed system for the winding rod;

a main forming cradle for a reel around said winding rod, the main forming cradle comprising a first winding roller and a second winding roller;

an unloading system configured to unload a reel of the plurality of reels when the reel is formed;

a controller;

a secondary pre-forming cradle for said reel, the secondary pre-forming cradle comprising a third winder roller and a lateral support system configured to support said reel;

a transfer system configured to transfer said reel from said secondary pre-forming cradle to said main forming cradle without interruption to winding of the strip onto said rod;

a first motor configured to cooperate with said spindles and to impart a rotation movement to said winding rod inside said secondary pre-forming cradle; and a gripping system configured to cooperate idly with said spindles and to support said winding rod above said main cradle, wherein cooperation between said first motor and said gripping system with said spindles enables that the reel in all forming phases is not abandoned.

2. The rewinder according to claim 1, wherein said gripping system comprises a pair of jaws configured to grip said spindles of said winding rod once said transfer system has moved said reel into said main cradle thereby allowing said first motor to abandon the spindles.

3. The rewinder according to claim 2, wherein said gripping system comprises:

a jaw guide configured to guide said jaws, and;

a third motor that is a screw/nut, the third motor being configured to impart a vertical translation movement to said jaws, along said guide.

4. The rewinder according to claim 2, wherein said unloading system of said formed reel comprises:

a grip guide configured to guide said gripping system, and;

a horizontal translation motor configured to impart a horizontal translation movement to said gripping system along said supporting frame by said grip guide.

5. A paper mill rewinder for forming reels of paper strip material around a winding rod, ends of the winding rod being provided with two spindles, said rewinder comprising:

a supporting frame;

a feed system for the winding rod;

a main forming cradle for a reel around said winding rod, the main forming cradle comprising a first winding roller and a second winding roller;

an unloading system configured to unload a reel of the plurality of reels when the reel is formed;

a controller;

a secondary pre-forming cradle for said reel, the secondary pre-forming cradle comprising a third winder roller and a lateral support system configured to support said reel; and a transfer system configured to transfer said reel from said secondary pre-forming cradle to said main forming cradle without interruption to winding of the strip onto said rod, said transfer system comprising:

a pair of supporting and moving arms for said reel, the pair of supporting and moving arms is configured to provide said lateral support for said secondary cradle in order to support said reel during a pre-forming phase by keeping the reel always in contact with said third winding roller and then to transfer said reel into said main cradle, and a second motor configured to impart an oscillating movement to said pair of supporting and moving arms.

6. The rewinder according to claim 5, wherein said transfer system comprises a slide disposed between said pair of supporting and moving arms and sliding thereupon, the slide being configured to support said reel in the pre-forming phase, the slide being in a single piece with said first motor.

7. A paper mill rewinder for forming reels of paper strip material around a winding rod, ends of the winding rod being provided with two spindles, said rewinder comprising:

a supporting frame;

a feed system for the winding rod;

a main forming cradle for a reel around said winding rod, the main forming cradle comprising a first winding roller and a second winding roller;

an unloading system configured to unload a reel of the plurality of reels when the reel is formed;

a controller;

a secondary pre-forming cradle for said reel, the secondary pre-forming cradle comprising a third winder roller and a lateral support system configured to support said reel;

a transfer system configured to transfer said reel from said secondary pre-forming cradle to said main forming cradle without interruption to winding of the strip onto said rod; and an index oscillating around an axis, the index being provided at one end with a ply-forming roller configured to interact with said strip under control of the controller to form a loop and facilitate its winding around said winding rod when placed in said secondary pre-forming cradle.

8. The rewinder according to claim 7, further comprising a plurality of nozzles configured to spray air or water at a determined pressure against said strip to push said loop between said winding rod and said third roller.

9. A paper mill rewinder for forming reels of paper strip material around a winding rod, ends of the winding rod being provided with two spindles, said rewinder comprising:

a supporting frame;

a feed system for the winding rod;

a main forming cradle for a reel around said winding rod, the main forming cradle comprising a first winding roller and a second winding roller;

an unloading system configured to unload a reel of the plurality of reels when the reel is formed;

a controller;

a secondary pre-forming cradle for said reel, the secondary pre-forming cradle comprising a third winder roller and a lateral support system configured to support said reel; and a transfer system configured to transfer said reel from said secondary pre-forming cradle to said main forming cradle without interruption to winding of the strip onto said rod, wherein said feed system comprises:

a pair of jaws configured to grip said spindles of said winding rod, and a vertical downward conveyor for said jaws, the vertical downward conveyor being configured to cooperate with said transfer system in the proximity of said secondary pre-forming cradle.

* * * * *